United States Patent [19]

Skafte et al.

[11] Patent Number: 4,784,110

[45] Date of Patent: Nov. 15, 1988

[54] WALL FURNACE

[75] Inventors: Stanley F. Skafte, Cherry Valley; Donald R. Dupras, Alta Loma, both of Calif.

[73] Assignee: Williams Furnace Company, Colton, Calif.

[21] Appl. No.: 931,227

[22] Filed: Nov. 14, 1986

[51] Int. Cl.[4] ..... F24H 3/02

[52] U.S. Cl. ..... 126/110 AA; 126/99 C; 126/99 R; 126/109; 237/53

[58] Field of Search ..... 126/99 C, 109, 99 R, 126/99 A, 110 AA, 116 B; 237/53, 70; 165/53, 150, 170

[56] References Cited

U.S. PATENT DOCUMENTS

| | | | |
|---|---|---|---|
| 2,044,371 | 6/1936 | Tuck | 126/99 R |
| 2,224,544 | 12/1940 | Keller | 126/109 |
| 2,792,826 | 5/1957 | Kilbury | 126/110 AA |
| 3,120,225 | 2/1964 | Stark et al. | 126/110 AA |

OTHER PUBLICATIONS

Suburban Manufacturing Company, Dayton, Tennessee, "Dynamaster Gas Floor Furnace", brochure (date unknown).

Brochure entitled "The Empire Floor Furnance" by Empire Comfort Systems, Form No. 0900, 11/18/87.

Brochure by Martin Industries, Inc. FUR-286-30, 11/18/87.

*Primary Examiner*—Larry Jones

*Attorney, Agent, or Firm*—Knobbe, Martens, Olsen & Bear

[57] ABSTRACT

The heat exchanger of a gravity flow wall furnace defines a tortuous, mostly vertical path for the combustion gases to improve heat transfer to the room. The gases are directed upwardly in a combustion chamber and then split into two portions and conducted through two radiators having paths which extend downwardly adjacent to but spaced from the chamber and then upwardly again leading to a flue. The chamber and the radiators are oriented edgewise with respect to the wall so that all can fit within the space between a pair of studdings in a conventional stud wall.

2 Claims, 2 Drawing Sheets

Fig. 1
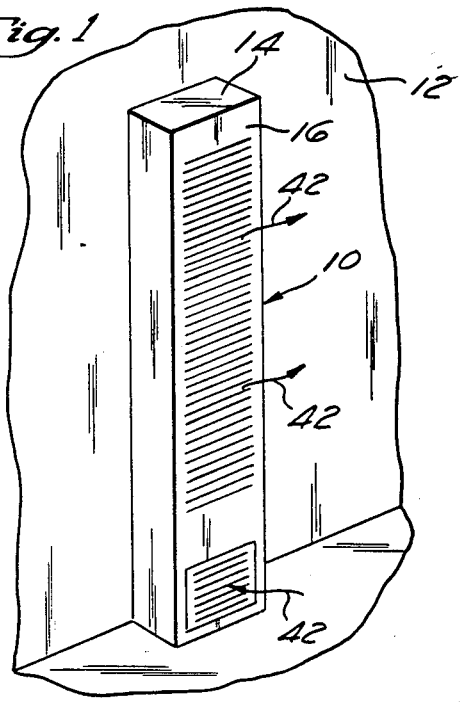
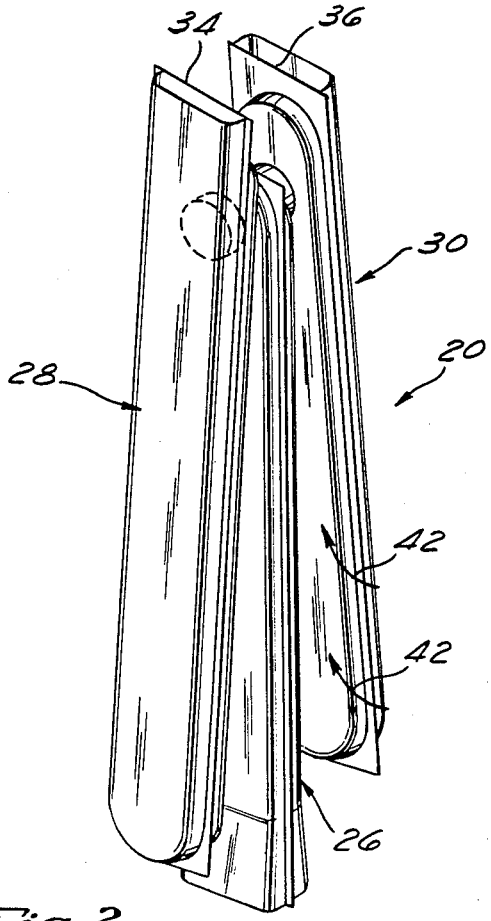
Fig. 2
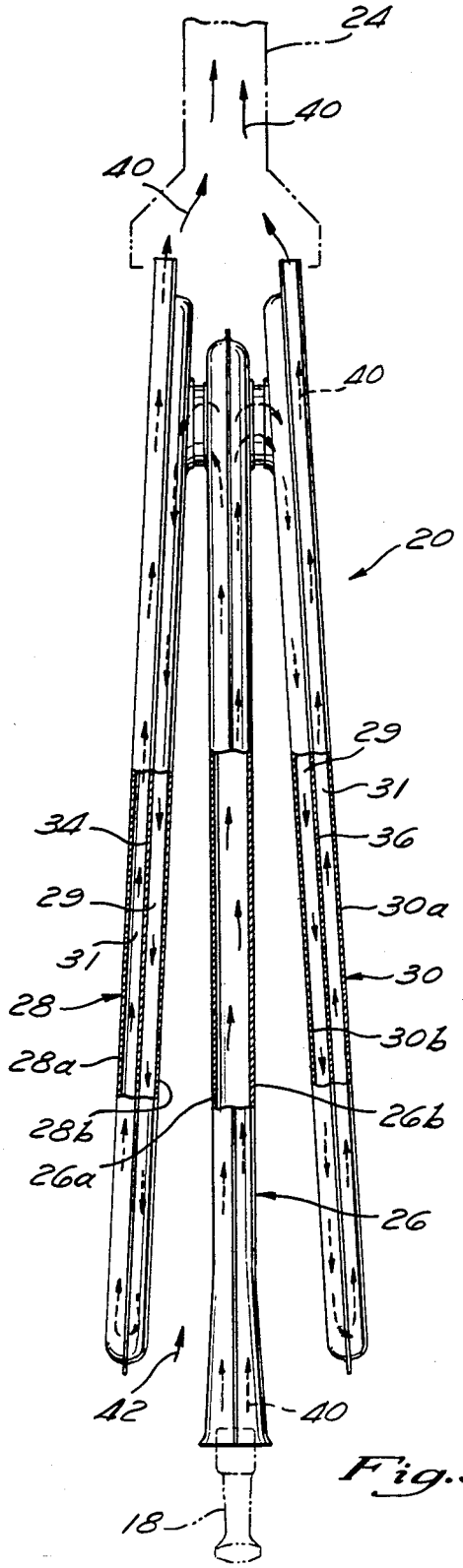
Fig. 3

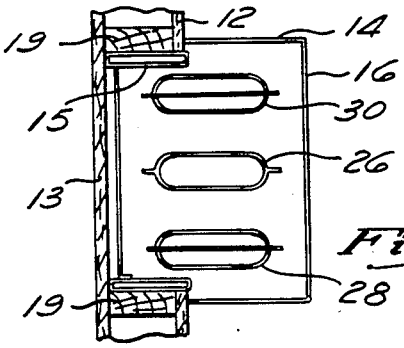
Fig. 5
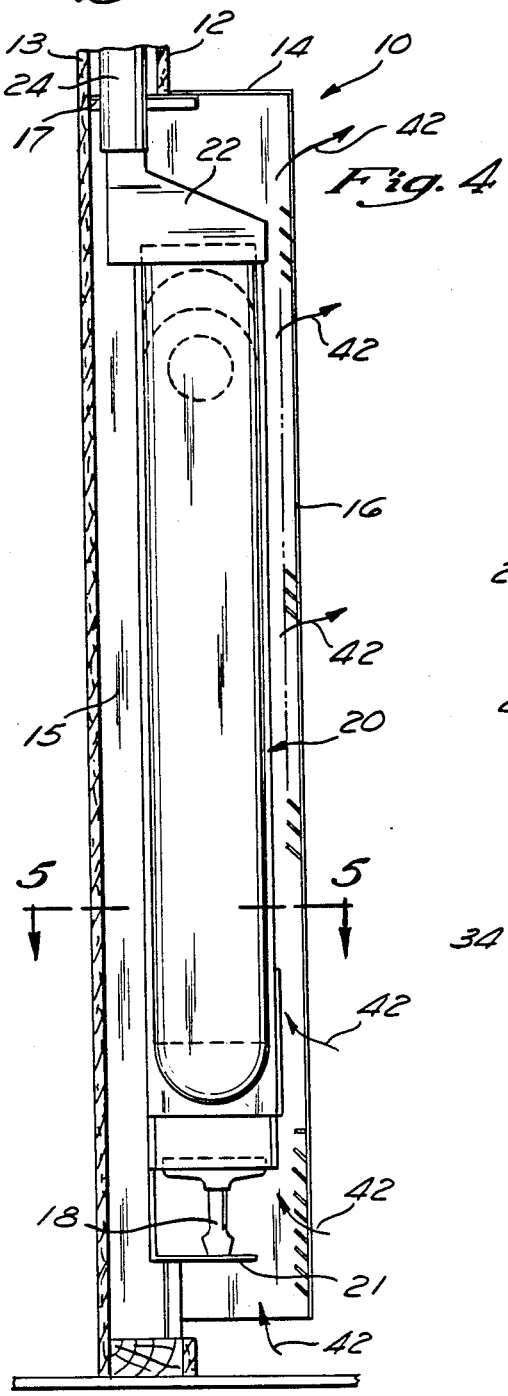
Fig. 4
Fig. 7
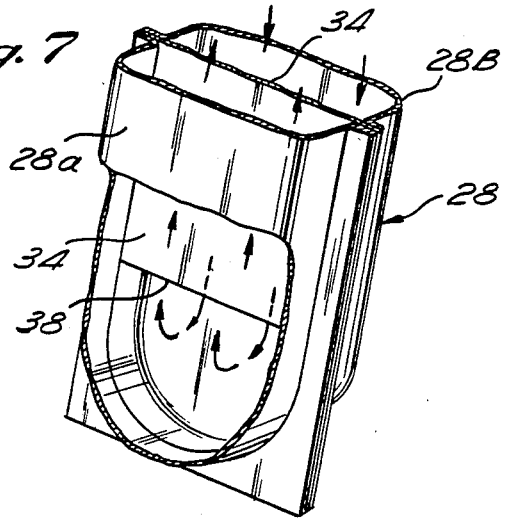
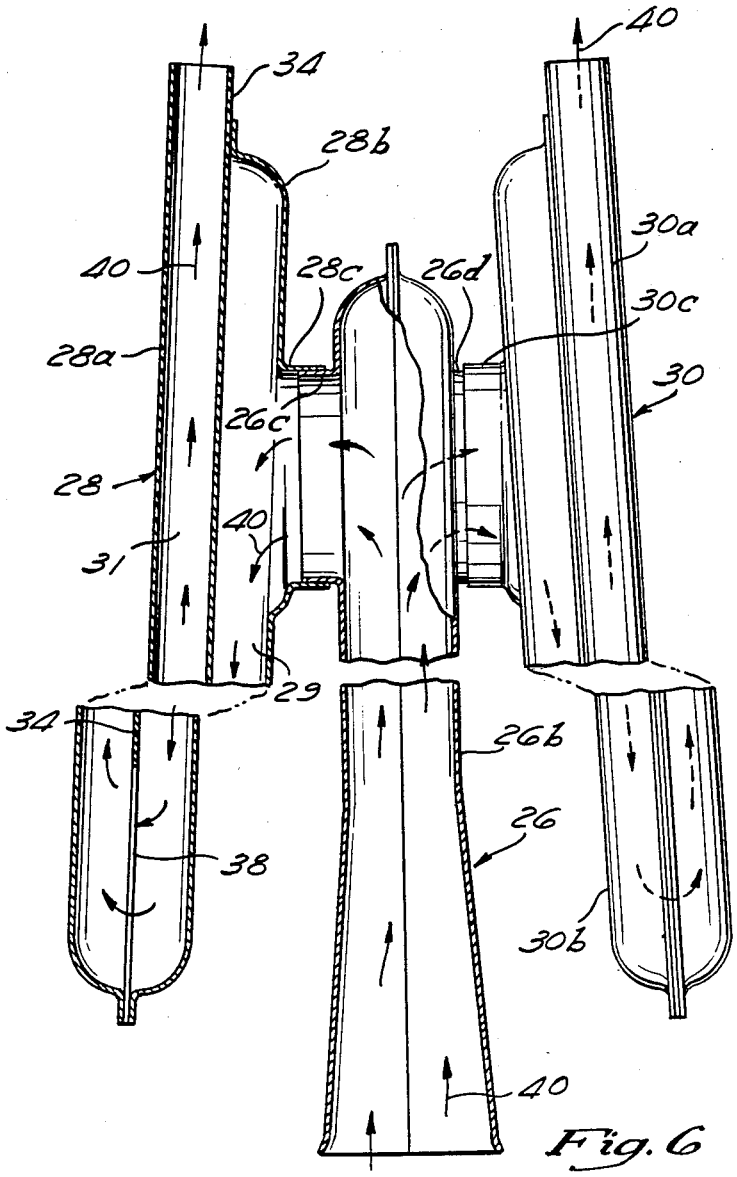
Fig. 6

WALL FURNACE

FIELD OF THE INVENTION

This invention relates to heating apparatus and more particularly to an improved heat exchanger and heat exchange method, especially useful in connection with a gravity flow wall furnace.

BACKGROUND OF THE INVENTION

Gas energized, gravity flow wall furnaces have been widely used for many years to provide heat for one or two rooms, typically in structures not having central heating. These furnaces are usually partially recessed into a wall in the space between two studdings in a conventional stud wall. Such space is normally only about 14⅜" wide. The furnace must also be very shallow since a conventional stud only provides a space about 3½" in depth and the furnace usually extends only another 3"–4" into the room. As a result of these dimensional constraints and because of cost, many such wall furnaces do not have a fan and simply rely on gravity for the flow of room air and combustion products. That is, the cool room air sinks and the warm room air and the hot combustion gases rise.

Current wall furnaces typically include a thin, flat, wide heat exchanger extending vertically in the wall, with the edges of the exchanger being positioned adjacent to but spaced from the studs in the wall. The combustion gases from a burner positioned at the lower end of the heat exchanger are ducted upwardly through the heat exchanger to a flue. Room air flows through a grill forming the wall of the furnace facing the room to be heated. Cool room air enters the furnace near the lower end of the heat exchanger, is heated from the exterior of the heat exchanger, and flows upwardly due to a decrease in density caused by heating, and exits back into the room at the upper end of the heat exchanger. With this simple arrangement, fairly effective heat transfer is obtained.

Typically, the highest thermal efficiency provided by such gravity flow wall furnaces has been about 70%. This roughly means the combustion process itself is fairly complete and that about 70% of the heat from the combustion gases is transferred into the room. This puts further constraints on the construction of the heat exchanger in that the combustion gases must flow upwardly through the heat exchanger with sufficient velocity to ensure that adequate air is drawn into the burner to provide sufficient oxygen and to produce a continued flow.

At the same time, it is desirable that the velocity of the combustion gases be sufficiently slow to maximize the heat transfer from the heat exchanger. The heat exchangers currently being used are quite thin and flat at their upper ends and usually include a plurality of interconnections between the front and back walls to impede flow, and thereby improve heat transfer to the room air flowing over the exterior surfaces of the exchanger.

Further constraints on the design and size of the furnace are that the temperatures of the walls surrounding the furnace and of the grill exposed to the room being heated must be kept to certain minimums to satisfy fire and safety requirements. Also, efficiency is reduced by th fact that some room air is allowed to enter a vent hood at the top of the heat exchanger to ensure the temperature of the combustion gases as they leave the furnace do not exceed a certain maximum.

In recent years, a further requirement involving conservation of energy has been governmentally mandated. This was primarily imposed with respect to forced air, central, gas heating systems, but the regulations are currently being interpreted to be applicable as well to wall furnaces. The 70% thermal efficiency rating of current wall furnaces does not satisfy this requirement. Thus, a need exists for an improved heat exchanger for a wall furnace that will improve efficiency and meet the various standards established. These standards must be met based on a gravity flow system, i.e. without the use of a fan to circulate room air or a fan to induce draft for the combustion process. Of course, such improvement must also be practical and inexpensive in order to be competitive from a marketing standpoint.

SUMMARY OF THE INVENTION

Briefly stated, the invention provides an improved heat exchanger and heat exchange method for a wall furnace, primarily by greatly lengthening the flow path of the combustion gases so that a greater percentage of heat may be extracted through the walls of the exchanger. This has been accomplished while still maintaining adequate combustion and fitting within the conventional space constraints of wall furnaces. In a preferred form of the invention, the increased flow path is obtained by providing a tortuous path for the combustion gases with sections or legs of the path extending primarily vertical so that the exchanger will fit within the narrow space available, and still maintain adequate flow of combustion gases.

The duct forming the flow path includes a combustion chamber section that is open to the burner on its lower end and is open at its upper end to a radiator section having a leg that extends downwardly adjacent to but spaced from the combustion chamber. Further provided in the radiator is an upwardly extending leg or section open at its lower end to the down leg and open at its upper end to a flue outlet. It has been found that with such an arrangement, there is sufficient momentum to the flow of combustion gases that an adequate, continuous flow is obtained even though the heated gas, which is less dense than the surrounding air, is directed downwardly as it flows through the first leg of the radiator flow path. This unexpected result provides for increased heat exchanger surface area and increased time that the hot gases are in the heat exchanger, resulting in increased heat transfer, such that the efficiency of the furnace is raised about 10% from prior art furnaces. This improvement is significant and impressive when one considers the quantity of energy consumed by wall furnaces.

In a preferred form of the invention, the output from the upper end of the conbustion chamber section of the heat exchanger is split into two portions with one portion being ducted down and then up through one radiator on one side of the combustion chamber and the other portion being ducted down and then up through a second radiator similar to the first and located on the other side of the first section. The cross-sectional flow area of the radiators are each only about half that of the combustion chamber.

From a standpoint of simplicity in construction, the heat exchanger combustion chamber is preferably formed by two shallow metal shells joined around their periphery by welding or other suitable means. A similar construction is provided with a central divider wall to form the radiator sections. The divider wall is open at its lower end so that the flow path through the down leg is open to the lower end of the up leg.

These duct structures have a generally rectangular or racetrack cross-section with one dimension being considerably longer than the other. Advantageously, the duct sections may be positioned in face-to-face spaced relation with their longer dimension being generally perpendicular to the wall in which the furnace is installed. This is in contrast to the single wide, flat heat exchanger currently employed in gravity flow wall furnaces, wherein the exchanger's longer cross-sectional dimension is generally parallel to the wall in which the furnace is installed. With the improved arrangement, a compact construction is provided that maximizes the heat transfer area within the limited space available.

BRIEF DESCRIPTION OF THE DRAWINGS

FIG. 1 is a perspective view of a furnace incorporating the invention, with the furnace being illustrated partially recessed in a wall.

FIG. 2 is a perspective view of the heat exchanger of the invention.

FIG. 3 is a front elevational partially sectionalized of the heat exchanger and schematically illustrating the flow of combustion products.

FIG. 4 is a side elevational view of the furnace recessed in a wall.

FIG. 5 is a cross-sectional view of the furnace on line 5—5 of FIG. 4.

FIG. 6 is an enlarged, cross-sectional view of the heat exchanger further illustrating its construction and schematically illustrating the flow of combustion products.

FIG. 7 is a perspective, partially sectionalized view of the lower end of one radiator section.

DETAILED DESCRIPTION OF THE PREFERRED FORM OF THE INVENTION

In FIG. 1, the wall furnace 10 of the invention may be seen to be recessed in a wall 12, but having an outer shell 14 extending into the room and a front louvered wall or grill 16 for room air flow.

As can be seen from FIGS. 3–5, the furnace includes a double walled frame 15 fitting between wall studding 19 and joined at the top by a header 17 and at the bottom by a wall 21. The frame supports a burner 18 located at the lower end of the unit, a vertically elongated heat exchanger 20 and a draft hood 22 leading to a flue 24, which extends upwardly in the space within the conventional stud wall between the front wall 12 and a rear wall 13.

The heat exchanger 20 is an elongated duct which includes a central combustion chamber section 26 and a pair of radiators 28 and 30 located on opposite sides of the combustion chamber 22. As seen from FIGS. 2 and 3, these constructions have similar profiles, each being vertically elongated with a generally flat elongated cross-section. This cross-section may be seen from FIG. 5 to be generally rectangular or oblong with rounded ends, giving it a generally racetrack configuration. It may also be best seen from FIG. 5 that the longer dimension of this racetrack shape extends generally perpendicular to the room wall 12. The radiators 28 and 30 are spaced outwardly from the central combustion chamber 26. The heat exchanger components are spaced from the surrounding room walls and furnace walls so that air is free to circulate over their exterior surfaces.

It is desirable that the flow passages defined by the heat exchanger sections be maximized, but at the same time, it is necessary that they be spaced for adequate air flow. Further, these sections must fit within the narrow space provided between two wall studdings 19 of the conventional stud wall. With a typical wall, the studdings are on 16" centers leaving the space between the studdings to be about 14⅜". Because of these space limitations, the cross sectional dimensions of the heat exchanger sections in a production form of the invention are about 6" in the longer dimension and a little less than 2" in the shorter dimension. The combustion chamber 26 flares to a wider cross-section at its lower end to almost 3" so as to better accommodate the burner 18 which, as may be seen from FIGS. 3 and 4, is positioned partially within the lower end of the combustion chamber.

These heat exchanger sections are economically formed by shallow shell-like members secured by welding or other suitable means around their peripheries. More specifically, the combustion chamber section 26 is formed by a pair of essentially identical, shallow shell-like members **26*a* and 26*b* having mating outer flanges or edges that are joined by welding. The radiator section 28 is similarly formed by a pair of shallow shell-like members 28*a* and 28*b*; however, in addition, there is an elongated flat divider wall or plate 34 that is positioned between the members 28*a* and 28*b*. The peripheries of the shell members and plate 34 are joined by welding or other suitable means. Similarly, the radiator section 30 is formed by shell members 30*a* and 30*b* and a divider wall 36**.

The upper end of each of the shells **26*a* and 26*b* have an opening therein formed by short, cylindrical, outwardly extending portions 26*c* and 26*d*, as best seen in FIG. 6. These outlets 26*c* and 26*d* are received within a mating cylindrical portion 28*c* and 30*c* formed in the shells 28*b* and 30*b***, respectively. These cylindrical portions are further clamped or connected together by suitable means not shown.

As seen from FIGS. 6 and 7, the divider wall 34 has an opening 38 in its lower end which extends across the entire cross-sectional space formed by the shells **28*a* and 28*b*. The divider wall 36 in the radiator 30** has a similar opening on its lower end.

As also seen from FIG. 6, the upper end of the wall 34 and the upper end of the outer shell **28*a* extend upwardly beyond the upper end of the inner shell 28*b*. Similarly, the wall 36 in the radiator 30 together with the outer shell 30*a* extend upwardly beyond the upper end of the inner shell 30*b***.

Although the combustion chamber section 26 extends vertically above the burner 18, the radiator sections angle outwardly slightly from the upper end to the lower end, as seen in FIG. 3. In a preferred form of the invention, the width of the heat exchanger tapers from about 5½" at the upper end to about 11" at the lower end. Also, the lower ends of the radiator sections 28 and 30 are spaced upwardly somewhat from the lower end of the combustion chamber section 26. This arrangement minimizes radiation heat transfer directly from the combustion chamber lower end to the lower ends of the radiator sections, while increasing the air flow between those components. There is less need for such space between the upper ends of the heat exchanger sections, and at the same time, it is desirable to space the heat exchanger sections from the surrounding housing and room walls. A radiation shield (not shown) may be provided around the lower ends of the heat exchanger to maintain the temperature of the walls surrounding that area of the furnace at a satisfactory level.

OPERATION

In operation, gas provided to the burner 18 is ignited in the lower end of the combustion chamber section 26. Room air is drawn in through the lower end of the front panel 16 of the furnace into the burner itself for premixing of air and gas. Additional room air is drawn in through the lower end of the combustion chamber through the space surrounding the burner 18. The hot combustion products are ducted upwardly as indicated by the arrows 40 in FIGS. 3 and 6. As further seen from those figures, the heat exchanger forms an elongated, tortuous or serpentine flow path for the combustion products which is much longer than the straight line path to the hood 22 or the flue 24. More specifically, the combustion chamber section of the heat exchanger defines a main initial flow path that extends directly upwardly from the burner 18. Since there is no blower or fan provided, this movement of combustion products occurs because the hot combustion products are less dense than the cool room air flowing in at the lower end of the furnace. The flow from the upper end of the combustion chamber 26 is split into two portions with one portion extending downwardly through a first leg or section 29 of each radiator 28 and 30. The combustion gases then flow through the opening 38 in the lower end of each of the divider walls 34 and 36, and flow upwardly in the outer legs or sections 31 of the radiators 28 and 30. From there, the combustion products pass through the draft hood 22 on their way to the flue 24. Some room air is drawn into the hood 22 to maintain the flue temperature below a maximum temperature.

The surprising and unexpected aspect of the invention is that the combustion products have adequate velocity to flow downwardly through the radiators before being able to once more travel upwardly through the outer legs of the radiator sections, while still maintaining adequate velocity to support efficient combustion. This appears to be accomplished by the fact that the combustion products attain sufficient velocity by the time they reach the upper end of the combustion chamber section and that the momentum of the combustion products is sufficient to maintain adequate velocity through the radiator sections. The elongated combustion chamber section, in a production form of the invention, extends for almost four feet. This is a sufficient distance to obtain the necessary velocity to maintain adequate combustion.

The goal of the heat exchanger, of course, is to maximize heat transfer into the room. Room air is drawn in through the fornt grill due to the heat given off by the heat exchanger. The cool room air flows over the exterior surfaces of the spaced heat exchanger sections, flowing upwardly and then outwardly into the room, as indicated by the arrows 42 in FIG. 4. The sinuous elongated passage defined by the heat exchanger for the combustion gases thereby extends the distance that the combustion products are exposed to the heat exchanger walls. This distance is about three times as long as the arrangement for prior art gravity flow wall furnaces, wherein the combustion products only flow directly upwardly from the combustion chamber to the flue. The greater distance correspondingly increases the time the gases are exposed to the heat exchanger. Further, the three heat exchanger sections including the two radiators provide a large amount of exterior surface over which the room air may flow. Note also that the radiators are spaced from the combustion chamber so that room air can flow between these various aspects of the system's maximum heat transfer from the heat exchanger to the room air.

Initial tests of the production form of the invention indicate that the efficiency of the heat exchanger illustrated is about 10% greater than that attained by earlier wall furnaces having a wide, flat heat exchanger with a single vertical flow path. In more specific terms, prior gravity flow wall furnaces had a maximum thermal efficiency of about 70%, whereas the furnace in accordance with the invention has been found to have a thermal efficiency reaching approximately 80%. Such an improvement translates into a very dramatic fuel savings and meets governmental standards.

It should be noted that the overall cross-section of the flow path for the combustion products remains relatively constant. That is, as may be seen from FIG. 5, the cross-section of the combustion chamber section 26 is about equal to the cross-section of the radiator sections 28 and 30. Only half of the combustion products flow through each of the radiator sections, but each radiator section is, in turn, split in half. The result is that the cross-sectional flow through the radiator sections is only about half that through the combustion chamber section, but the quantity of combustion products is only about half through the radiator sections. It has been found that this arrangement is desirable from a standpoint of obtaining a smooth flow of combustion products and also from a practical standpoint concerning the manufacture and mounting of the heat exchanger sections.

While these results are obtained without the use of a fan to move room air or to induce draft to the combustion chamber, fans can of course be used if desired.

What is claimed is:

1. A wall furnace adapted to fit between a pair of studdings in a conventional stud wall of a room with a portion of the furnace extending outwardly into the room, said furnace comprising a burner; and a heat exchanger having duct means defining an elongated flow path including a vertically oriented combustion chamber having an inlet at its lower end to receive combustion gases emanating from the burner, said duct means further including a first radiator located on one side of said combustion chamber, said radiator having a vertically elongated downwardly extending section connected at its upper end to the upper end of said chamber and an upwardly extending elongated section connected at its lower end to the lower end of said downwardly extending section, said duct means also including a second radiator located on the opposite side of said combustion chamber from said first radiator, said second radiator having a vertically elongated downwardly extending section open at its upper end to the upper end of said chamber and a vertically elongated upwardly extending section having its lower end connected to the lower end of said second radiator downwardly extending section, the upper end of each of the upwardly extending radiator sections being adapted to be connected to a flue, said combustion chamber and said radiators each having a vertically elongated configuration with a generally flattened cross section wherein the longer dimension of the cross section extends generally perpendicular to the wall in which the furnace is to be installed, and the shorter dimension extends generally parallel to said wall, said radiators each having a divider which extends generally perpendicular to said wall, the divider dividing the radiators into said downwardly extending and upwardly extending sections which are in communication with each other at the lower end of the divider said radiators being spaced from the combustion chamber except at the upper end where the radiators are in communication with the combustion chamber so that air may circulate between the radiators and the combustion chamber, the configuration of the combustion chamber and the radiators nevertheless being sufficiently flat that the spaced chamber and radiators will fit between the studdings of a conventional wall.

2. The furnace of claim 1, wherein said radiators diverge at their lower ends so as to be spaced further from the lower end of said chamber than they are from the upper end of said chamber.

* * * * *